United States Patent [19]

Shay

[11] Patent Number: 4,593,642

[45] Date of Patent: Jun. 10, 1986

[54] CARRYING CASE FOR CANOE

[76] Inventor: Charles W. Shay, 400 Shay Lane, Matamoras, Pa. 18336

[21] Appl. No.: 675,679

[22] Filed: Nov. 28, 1984

[51] Int. Cl.[4] ..... B63B 27/00

[52] U.S. Cl. ..... 114/347; 114/364; 441/43

[58] Field of Search ..... 114/364, 347, 343, 360; 441/43

[56] References Cited

U.S. PATENT DOCUMENTS

| | | | |
|---|---|---|---|
| 1,172,974 | 2/1916 | Frayser | 114/347 |
| 3,192,542 | 7/1965 | Mills | 114/364 |
| 3,691,572 | 9/1972 | Yannes | 114/347 |
| 3,958,289 | 5/1976 | Carison | 114/347 |
| 4,016,615 | 4/1977 | Main | 114/347 |
| 4,086,868 | 5/1978 | Lutters | 114/364 |
| 4,357,894 | 11/1982 | Kirk | 114/347 |
| 4,380,208 | 4/1983 | Goserud | 114/364 |
| 4,398,488 | 8/1983 | Mathieu | 114/343 |
| 4,503,799 | 3/1985 | Masters | 114/347 |

*Primary Examiner*—Trygve M. Blix
*Assistant Examiner*—C. T. Bartz
*Attorney, Agent, or Firm*—Wolder, Gross & Yavner

[57] ABSTRACT

A carrying case for canoe that will hold supplies under watertight conditions, will not be dislodged from the canoe should it be overturned or subject to other violent exterior conditions, and will aid in flotation in subsequent righting, should the canoe be overturned. The case is configured to straddle the center thwart. It is waterproof and airtight. It has a plurality of securing latches which detachably grip the gunnels of the canoe. The cover extends four to five inches above the canoe lip to significantly increase the water displacement should the canoe be overturned, thus improving the flotation characteristics of the canoe and improving the user's ability to right the canoe with a small volume of water remaining within the hull.

11 Claims, 4 Drawing Figures

CARRYING CASE FOR CANOE

BACKGROUND OF THE INVENTION

The present invention relates to a carrying case for a canoe, and more particularly to a carrying case which may be detachably yet firmly secured to the interior of the canoe.

Providing containers to carry supplies for canoes is a technology which developed coincident with the original development of the canoe itself.

For example, U.S. Pat. No. 4,398,488 discloses a device in which an insulator container is wedged within the body of the canoe. This requires a forcing action and could possibly damage the canoe, and there is always the possiblity that the container will be dislodged.

U.S. Pat. No. 3,958,289 discloses a watertight compartment that is mentioned as assisting in the flotation devices attachable, but it is small, lies across the center of the canoe and does not have the strong attachment set forth in the present invention.

U.S. Pat. No. 1,172,974 is also another example of an early water and airtight container which may be placed in the fore or aft of the canoe.

Accordingly, it is among the objects of the present invention to provide an improved carrying case for a canoe.

Still yet another object of the present invention is to provide a carrying case for a canoe which will have a sufficiently large cubic volume to carry meaningful supplies.

Still yet a further object of the present invention is to provide a strong, positive detachable means for securing the case to the canoe so that it will not be dislodged when the canoe is subject to violent forces, or overturned.

Still yet a further object of the present invention is to provide a device which simply and inexpensively provides a watertight seal so that if the canoe is overturned, no type of damage will come to the items stored in the interior of the case.

Still yet a further object of the invention is to provide a carrying case which is large enough to provide a stabilizing force for the canoe.

Yet another object of the present invention is to provide a device of the character described which will include the flotation characteristics of the canoe and, should the canoe be overturned, will significantly reduce the amount of water remaining in the canoe after it is righted.

BRIEF DESCRIPTION OF THE INVENTION

The present invention is directed toward a carrying case for a canoe which is capable of carrying a significant cubic volume of goods. The case is designed so as to be watertight with a detachable cover and has a center channel in its bottom to straddle the center thwart of the canoe. The unit is supported on the thwart and has latching means which are pivotally secured to the case, and has adjustable means to grip the outer side lip of the gunnels of the canoe. The preferred embodiment has four latches. The top of the cover extends approximately 4 to 5" above the gunnels of the canoe at the point of attachment. Accordingly, should the canoe be subject to violent exterior forces, the case will not be dislodged. Furthermore, should the canoe be overturned, the case will not be dislodged, and, furthermore, because of its flotation characteristics, there will be a significant air pocket within the overturned canoe, and when it is righted, only a small amount of water will remain within the canoe. This particular feature significantly aids in the ease in operating the canoe.

The above description, as well as further objects and advantages of the present invention will be more fully appreciated with reference to the following detailed description of a preferred, but none the less illustrative embodiment of the invention, when taken in conjunction with the following drawings wherein.

DETAILED DESCRIPTION OF THE DRAWINGS

Figure 1:
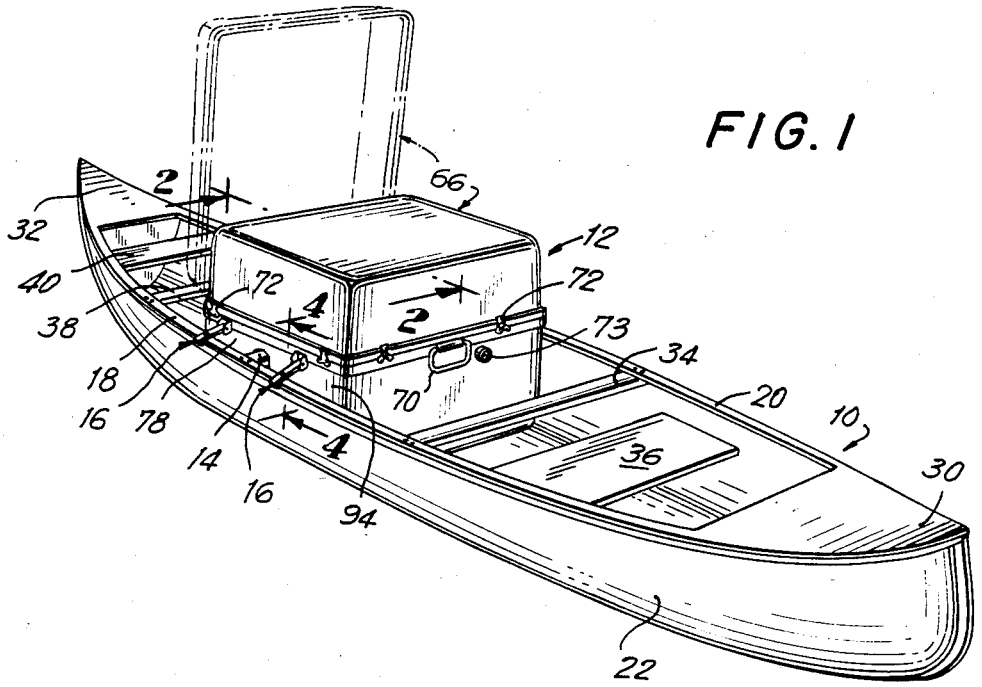
FIG. 1 is a front perspective view of a carrying case for canoe hull secured within position in the canoe, and showing in phantom, the cover in a pivoted open position.

Turning in detail to the drawings, and more particularly to FIG. 1, there is shown a canoe 10 and positioned therein a carrying case 12 embodying my present invention. The carrying case straddles the center thwart 14 and is secured by means of securing latches 16 to the side lip 18 of the gunnels 20.

Figure 3:
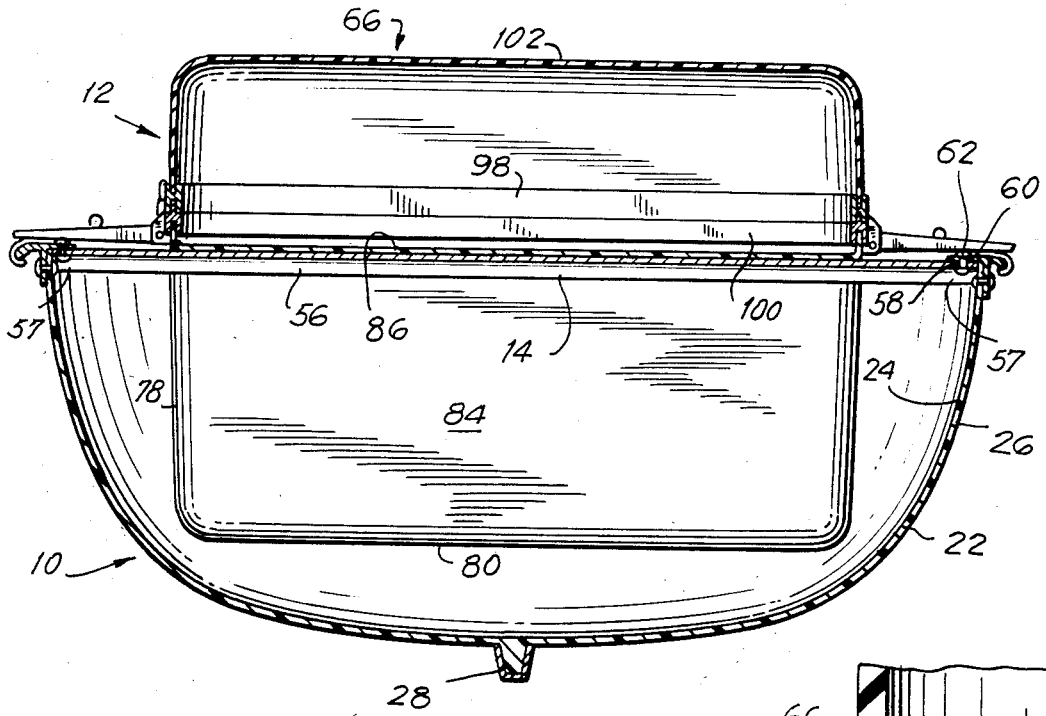
FIG. 3 is a cross-sectional view taken along the line 3—3 of FIG. 2.

Turning specifically to the canoe, it can be fabricated from any standard common material, such as aluminum, and is defined in the usual fashion by the body 22 further defined by an inner surface 24 and outer surface 26 and centered at its base by a keel 28 (FIG. 3). For purposes of orientation, the canoe has a front portion or fore 30 and a rear portion or aft 32. In addition to the center thwart 14, there is a forward thwart 34, a forward seat 36, a rear thwart 38 and a rear seat 40. The upper portion of the canoe is framed in the standard manner by the gunnels 20 and particularly the side lip 18 as better seen in FIG. 4 where the side lip can be seen as formed as a T-member with a leg 42 having a hole 44 defined therein mating with a hole 46 in the body 22 of the canoe 10. The lip is joined to the body by means of a double headed rivet 48 periodically spaced along the periphery of the gunnels.

Turning back to the side lip, the upper portion is defined by an inner arm 50 and, and outer arm 52 terminating in an annular bead 54.

The thwarts enhance rigidity and overall strength of the canoe, and as best seen in FIG. 3, the center thwart 14, which is shown as representative of all three thwarts, consists of a rigid extended rounded member 56 terminating in free ends 57. The ends have defined therein holes 58 mating with holes 60 located in the inner arm 50 of the lip 18 and aligned with the holes 58 into which passes a rivet 62 joining the thwarts to the side lip of the gunnels.

Figure 2:
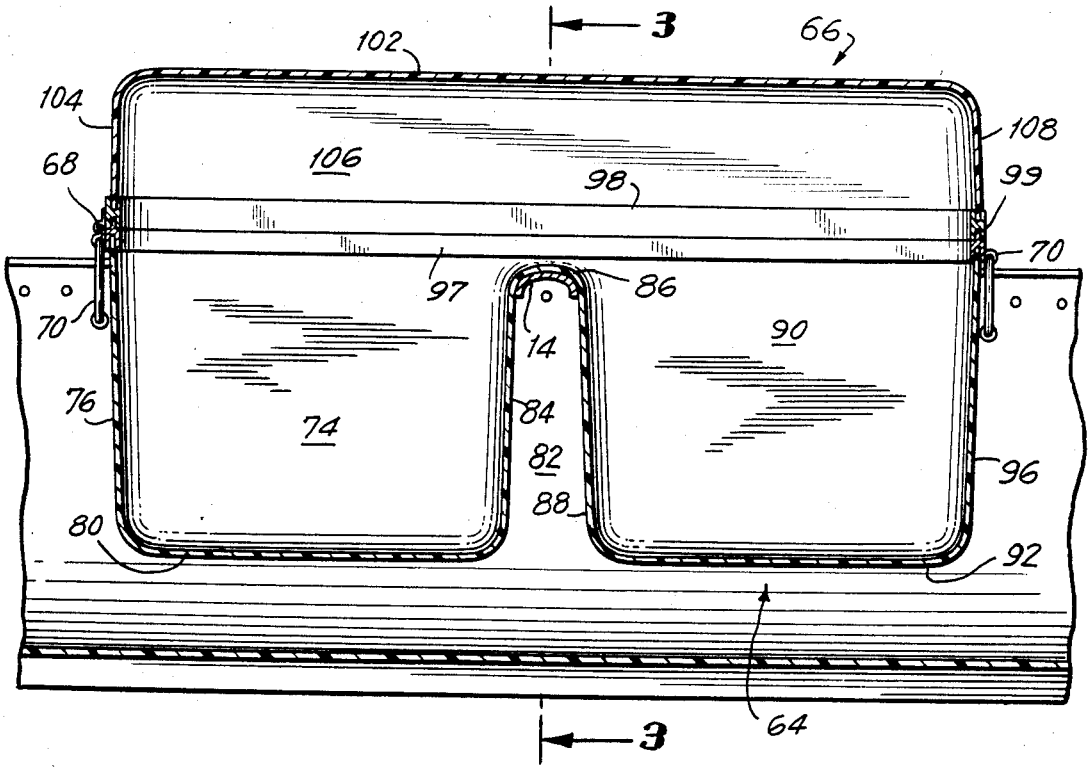
FIG. 2 is an enlarged, fragmentary view taken along the line 2—2 of FIG. 1.

The carrying case 12, as best seen in FIGS. 1–3, may be made of ABS Plastic, such as Acrylonitrile, butadiene or styrene, and is formed of molded shells. The base 64 which is also the main storage compartment has an average thickness of approximately 0.113" and the cover 66 has an average thickness of 0.13". Furthermore, the top of the cover extends approximately 5" above the gunnels of the canoe at the point of attachment. The two portions are joined by a separable hinge 68 so that the cover may be either pivoted to the position as shown in phantom in FIG. 1, or the cover may be completely lifted off and removed from the base. In order to facilitate carrying of the case, there are provided handles 70 which are attached to the base of the unit.

The cover is securely fastened to the base by means of a series of clamps 72 located on both the front and sides, and which facilitate in forming a watertight seal between the cover and base. The clamps are commercially available from Camloc Latches, and are identified by part No. SK-M-410. Optionally, an air pressure relief valve 73 may be secured to the base adjacent the handle 70, for example. A typical valve is No. 790-R.P.V. from Halkey Roberts Corporation of St. Petersberg, Fla. The valve equalizes the pressure between the interior of the case and the ambient atmosphere.

The base 64 is defined by a rear base storage compartment 74 defined by a rear wall 76, side walls 78 and a bottom wall 80. Defined in the center of the base is the center channel 82 defined by the channel rear wall 84, the bearing wall 86 and the channel front wall 88. The base then forms the front base storage compartment 90 further defined by bottom wall 92, side walls 94 and front wall 96.

The cover and the base are joined by an edge frame 97 which includes a female cover edge frame 98 having a gasket 99 positioned therein and mating with a male base edge frame 100. The frames are formed of an aluminum alloy extrusion and are secured completely around the open perimeters of the shelf. The gasket is a rubber tubular gasket designed to add to the water integrity of the unit.

The cover 66 is defined by a top wall 102 and as previously mentioned stands approximately 5" above the gunnels at the point of attachment. It is further defined by a rear wall 104, side walls 106 and a front wall 108. As previously mentioned, the cover terminates in the perimeter engaging cover edge frame 98.

Figure 4:
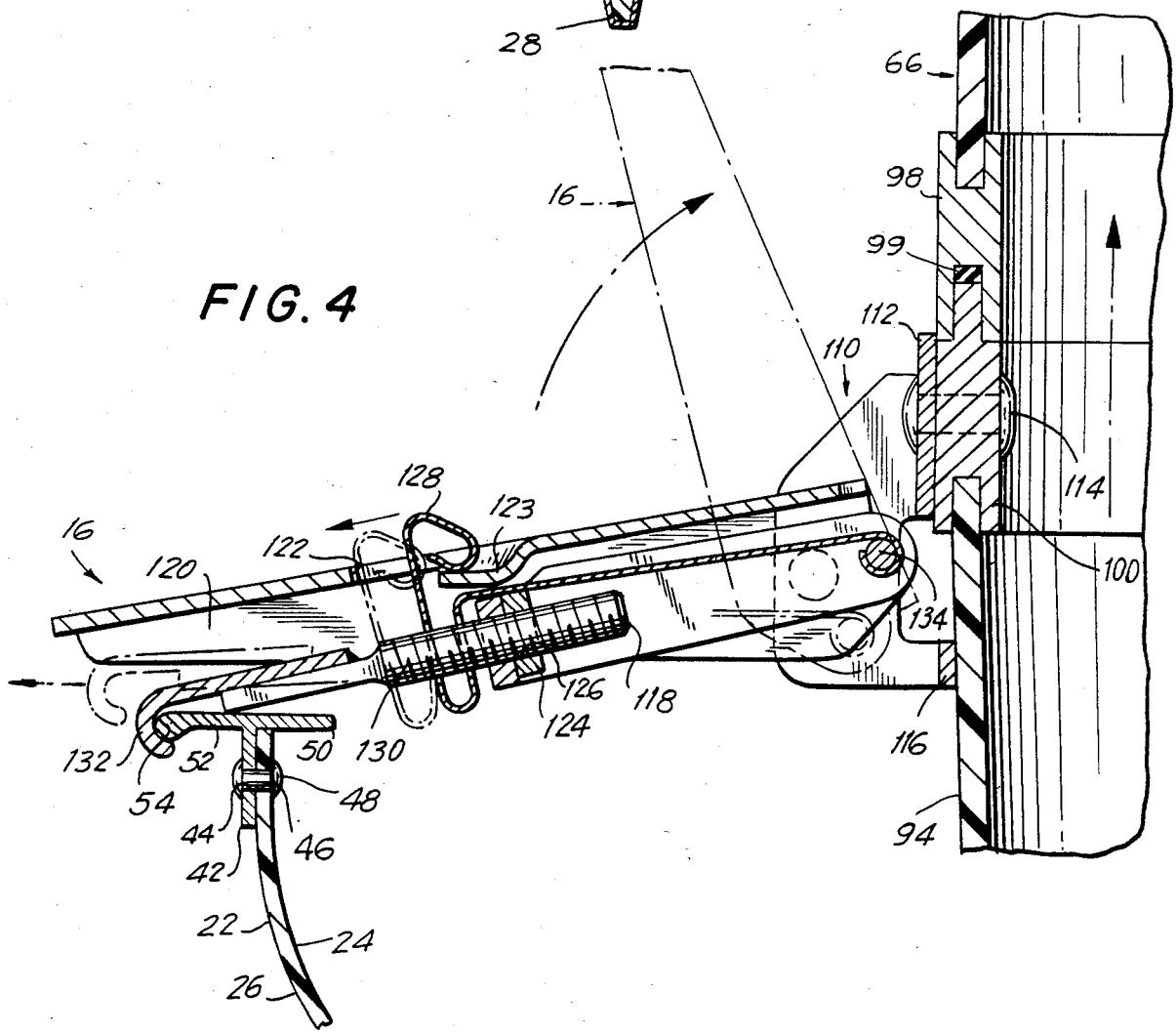
FIG. 4 is a significantly enlarged, fragmentary view taken along the line 4—4 of FIG. 1.

The securing latch 16 is commercially available from Camloc Latches, and is made of zinc plated steel. The particular unit shown is Number 17L01-1X2AA and is known as the secondary lock version. As best seen in FIG. 4, the latch consists of a strike or base 110 having an upper plate 112 abutting the cover edge frame 100 and joined thereto by a double headed rivet 114. The lower edge of the strike has a leg 116 abutting the side wall 89, 94 of the base. The latch consists of the standard shim construction 118 and consists of a handle 120 with an opening 112 defined therein and also an engagement shelf 123. The shim further has defined an angle plate 124 carrying a threaded opening 126. Extending upwardly from the angle plate is an upstanding finger 128. Extending through the threaded opening 126 is a threaded adjustable draw hook 130 having secured thereto a finger 132. The shim is secured to the strike by means of the standard pivot toggle 134.

In operation, the case may be filled with any desired products, such as food, cold drinks and ice, clothing, etc. The inside volume is approximately 9.5 cubic feet with the outside volume being approxiamtely 9.75 cubic feet. After the unit has been completely filled, the cover may be either placed on top within the edge frames with the rubber gasket 99 assisting in forming a watertight seal, and the clamps 72 may then be secured. The clamps are a typical cam action, steel tension latch which further assist in assuring the watertight integrity of the interior of the case 12. The unit may then be lifted by the handles 70 and placed within position in the boat, this position, as seen in FIG. 2, consists of placing the center channel 82 over the center thwart 14 with the bearing wall 86 resting directly upon the member 56 of the thwart. This provides the required support for the compartment. The securing latches 16 are then placed in secured position. As seen in FIG. 4, the threaded draw hook 130 is turned until the finger 132 comfortably engages the annular bead 54 on the outer arm 52 of the side lip 18. The handle which has been in the upward phantom position is lowered to the solid position and the finger which is shown in the beginning in the phantom position engages the bead as shown in the solid position. The upstanding finger 28 moves from the phantom position to the solid position to engage the shelf 123. Alternatively, the latch may have a hole in its upstanding figure so that a padlock may be passed therethrough adding to the security of the unit. The latches, of which there are four in the embodiment illustrated, firmly secure the side lips of the gunnels and the unit is now in position for forward movement in the boat. The user may then get in the canoe and paddle to provide transport to wherever desired. Should the canoe come upon violent outside forces, such as from a storm or running rapids in a river, the latches provide a secure attachment so that the case will not fall out of the canoe or be dislodged from the canoe. Should the canoe overturn, once again, the latches will prevent dislodgement of the case from the canoe. Furthermore, because of the size of the compartment, it adds to the flotation features of the canoe providing a significant air bubble underneath the overturned canoe. This facilitates a righting of the canoe and makes it particularly easy, should the overturning be done in deep water, where it would not be possible for the user to touch ground as a means for providing extra leverage to right the canoe. Upon righting, because of the significant air bubble, only about one to one and one-half inches of water will be located on the interior of the canoe. This provides an extra added feature to the invention, a benefit gratefully appreciated by those who ever had a canoe overturned in deep water.

There is thus provided a simple and economical means of providing a watertight carry means which can be secured to the canoe and which will not be dislodged under any conditions, and which further provides very desirable flotation features should the canoe overturn.

As can be seen, the present invention provides a significant advance over the state of the technology. As numerous additions, modifications and constructions can be performed within the scope of the invention, such scope is to be measured by the claims herein.

What is claimed is:

1. An improved carrying case for a canoe having a side lip and a transverse thwart which comprises:

(a) A storage container having means to allow access to the interior thereof, the container having a transverse medial channel separably straddling the thwart and delineated by side walls and an upper cross wall, the cross wall resting on and loading the thwart;

(b) adjustable securement means to detachably secure the container within the interior of the canoe, at least one means engaging the side lip of the canoe proximate the thwart;

(c) the conatiner extending substantially above the side lip of the canoe;

whereby, the case provides a secured storage which cannot be dislodged should the canoe be subject to violent conditions, such as overturning, and the case also provides substantially improved flotation characteristics to the canoe.

2. The invention according to claim 1, wherein the case is watertight.

3. The invention according to claim 2 wherein the container extends approximately 5" above the lip of the canoe.

4. The invention according to claim 1, wherein the adjustable securement means includes a securing latch containing an adjustable draw hook, the hook terminating in an extended finger, the finger engaging the side lip of the canoe when the container is secured within the interior of the canoe.

5. The invention according to claim 1, wherein the container is formed from a hollow plastic material, an adjustable hinge secured to the rear of the container, at least one handle secured to the container to provide ease of movement, and latches designed to securely shut the container.

6. The invention according to claim 2, wherein the adjustable securement means includes a securing latch containing an adjustable draw hook, the hook terminating in an extended finger, the finger engaging the side lip of the canoe when the container is secured within the interior of the canoe.

7. The invention according to claim 2, wherein the adjustable securement means includes a securing latch containing an adjustable draw hook, the hook terminating in an extended finger, the finger engaging the side lip of the canoe when the container is secured within the interior of the canoe, and wherein the container is formed from a hollow plastic material, an adjustable hinge secured to the rear of the container, at least one handle secured to the container to provide ease of movement, and latches designed to securely shut the container.

8. The invention according to claim 2, wherein the container is formed from a hollow plastic material, an adjustable hinge secured to the rear of the container, at least one handle secured to the container to provide ease of movement, and latches designed to securely shut the container.

9. The invention according to claim 5, the container including a cover and a base, the perimeters of the cover and base carrying a perimeter mating male and female edges, including a gasket positioned within the female edge to secure the watertight integrity of the case.

10. The invention according to claim 7, wherein the container includes a cover and a base, the perimeters of the cover and base carrying a perimeter mating male and female edges, including a gasket positioned within the female edge to secure the watertight integrity of the case.

11. The invention according to claim 1, wherein said securement means extends transversely between said container and said lip and is manually transferrable between an open extended condition and a closed contracted condition.

* * * * *